United States Patent [19]

Leupold

[11] Patent Number: 4,658,228

[45] Date of Patent: Apr. 14, 1987

[54] CONFINEMENT OF LONGITUDINAL, AXIALLY SYMMETRIC, MAGNETIC FIELDS TO ANNULAR REGIONS WITH PERMANENT MAGNETS

[75] Inventor: Herbert A. Leupold, Eatontown, N.J.

[73] Assignee: The United States of America as represented by the Secreatry of the Army, Washington, D.C.

[21] Appl. No.: 861,464

[22] Filed: May 1, 1986

[51] Int. Cl.[4] ..... H01F 3/12

[52] U.S. Cl. ..... 335/211; 335/214; 335/304

[58] Field of Search ..... 335/210, 211, 214, 301, 335/302, 304, 306

[56] References Cited

U.S. PATENT DOCUMENTS

| | | | |
|---|---|---|---|
| 3,182,234 | 5/1965 | Meyerer | 335/214 X |
| 3,205,415 | 9/1965 | Seki et al. | 335/301 X |
| 3,227,931 | 1/1966 | Adler | 335/304 |
| 3,237,059 | 2/1966 | Meyerer | 335/306 X |
| 4,578,663 | 3/1986 | Sanders et al. | 335/210 |
| 4,580,120 | 4/1986 | Jacquot | 335/214 |

*Primary Examiner*—George Harris

*Attorney, Agent, or Firm*—Sheldon Kanars; Jeremiah G. Murray; Maurice W. Ryan

[57] ABSTRACT

A magnetic device of permanent magnet materials for the control of linearly extending annular cross-sectioned magnetic fields formed of two concentrically nesting magnetic tubular elements defining an annular space therebetween, and inner and outer cladding magnets radially disposed around the outer of said tubular elements and interiorly of the inner of said tubular elements, the cladding magnets being thicker at the end extremities and diminishing in thickness towards and to the plane of zero magnetic potential at or near the center line of the device measured along its longitudinal axis.

5 Claims, 1 Drawing Figure

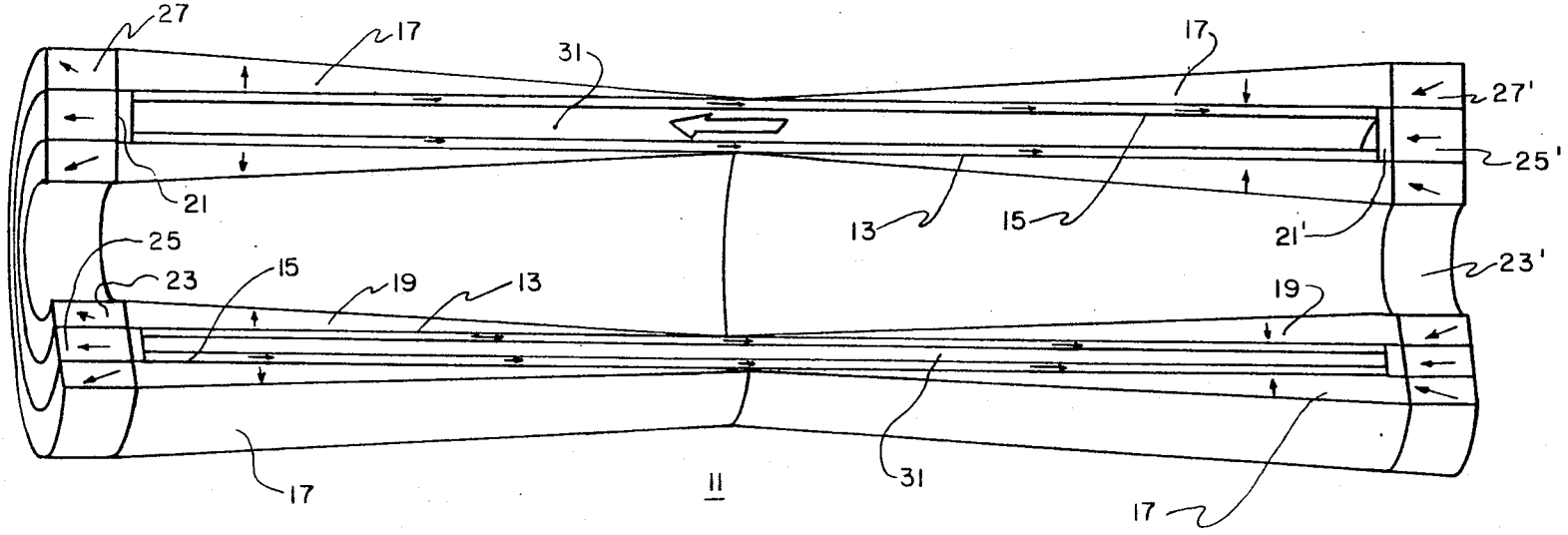
27'
25'
23'
21'
19
17
15
13
31
11
31
13
17
19
15
17
27
21
25
23

CONFINEMENT OF LONGITUDINAL, AXIALLY SYMMETRIC, MAGNETIC FIELDS TO ANNULAR REGIONS WITH PERMANENT MAGNETS

The invention described herein may be manufactured, used, and licenced by or for the Government of the United States of America for governmental purposes without the payment to me of any royalties thereon.

BACKGROUND AND FIELD OF THE INVENTION

This invention relates to the field of magnetic circuits for electronic devices, particularly to the adaptation and application of permanent magnets rather than electromagnets in applications for such devices and, more particularly, to a unique magnetic circuit which provides for the establishment, maintenance, and control, of an axially extending electromagnetic field of annular configuration viewed cross sectionally.

The utilization of permanent magnet devices and structures to replace electromagnetic type yokes in electronic devices, cathode ray tubes for instance, has received significant acceptance in the electronics industry. To achieve the proper operation of electron beam type devices it is most times necessary to apply a magnetic field having its flux lines parallel to the longitudinal axis of travel path of the electrons being controlled. Quite frequently, this space assumes the shape of a long cylinder and the flux lines to be developed parallel to the axis of such a cylinder have been conventionally produced for many years by shielded solenoids. Such solenoids require extremely critical power regulation, and if the field strength is of a significant magnitude, cooling may be required. The power and cooling requirements of such electromagnetic and solenoid type devices have been advantageously replaced by the present day developments in the use of permanent magnet structures to produce the controlling longitudinally extending linear flux fields for the control of these electron beam flows.

Various prior art devices have contributed to the development of the technology in this area. For example, the U.S. Pat. No. 3,768,054, to Neugebauer, entitled "Low Flux Leakage Magnetic Construction", teaches a number of magnetic circuits utilizing magnetic cladding means to reduce exterior flux leakage and increase the controlled magnetic field intensity. The advantageous features of this and similar devices are, significantly, the reduction of flux loss and very effective control without any increase, in fact most time a decrease, in the size or weight of the magnetic circuit elements.

In my own copending application Ser. No. 685,426, filed Dec. 24, 1984, entitled "Lightweight Cladding for Magnetic Circuits", I disclose and claim the advantageous features of certain magnetic structures arranged with flux fields transverse to each other and with tapered thicknesses of the restraining cladding magnetic elements in order to effectively control and maintain the linearity and constancy of the working flux in the flux spaces of such devices.

In all of the prior art there appears to be, even in the most recent developments, the control of axially extending magnetic flux fields through cross sectional areas which are complete and uninterrupted, that is to say in the form of squares, rectangles, circles and the like geometric shapes.

With the attainment of greater advances in the art some devices that have been developed, while having axial symmetry, require magnetic fields within only short distances from their peripheries. In such configurations, the provision of a magnetic field over the entire interior would require unnecessarily massive and bulky components, and be unduly prodigal of magnetic material.

With this, then, being the state of the art, I conceived and developed in the present invention to provide for the control of linearily extending flux fields in an annular cross section axially extending permanent magnet structure.

It is a primary object of the present invention to provide for the development and control of axially extending magnetic flux fields in annular shaped spaces, that is to say, shell-like tubular cylindrical elements having inner and outer shells between which the flux field obtains, said flux field being maintained constant or controllably varied, as desired, in accordance with the particular cladding and arrangement of permanent magnet structures in the combination.

It is, additionally, an object of this invention to provide for the control of axially extending longitudinal magnetic flux fields by the application of varying or tapered thickness type permanent magnetic structures arranged and disposed along the length of the device, and oriented with the magnetic flux therein transverse to the flux of the magnetic element which produces the axially extending field.

A still further object of the invention is to provide a permanent magnet electronic control device which can furnish an axially extending controllable magnetic flux field with minimal weight and space requirements, optimum economy of magnetic materials, and which requires no external power.

These and other objects and features of the invention will become the more readily apparent in the light of the ensuing detailed disclosure, particularly in the light of the drawing, which is a sectional-elevational view taken through a permanent magnet device according to the present invention.

SUMMARY OF THE INVENTION

In general, the invention according to my concept comprehends an inner and an outer cylindrical permanent magnet pair, concentrically disposed and extending longitudinally to define an annular flux space therebetween, a first array of cladding magnets disposed exteriorly of the outer of said permanent magnets, extending longitudinally therewith and tapering in thickness from their ends, towards and to the centers thereof, along the longitudinal axis, a second array of cladding magnets arranged interiorly of the inner of said permanent magnets, extending longitudinally therewith and tapered from the ends thereof towards and to their centers, iron pole pieces disposed at the ends of said annular flux space, and annular permanent magnet members disposed concentrically at each end of the permanent magnet array.

In a particular embodiment of apparatus according to the invention, the annular working space for the flux defined between the inner and outer permanent magnets is closed at each end by iron pole pieces and closed over by annularly disposed bucking magnets. The cladding magnets comprise tapering permanent magnet elements, generally conical in shape, and extending from a relatively wide base portion at each end of the structure, decreasing in thickness towards the center thereof, until minimal thickness is reached at the midpoint.

DETAILED DESCRIPTION

With reference to the single FIGURE of the drawing, a magnetic device according to the present invention is shown at 11. An inner tubular permanent magnet 13 is shown concentrically disposed within an outer permanent magnet 15. These permanent magnets are tubular or cylindrical (hollow) in shape and define between them, a working flux space, annular chamber 31. An array of outer cladding magnets 17 is shown disposed concentrically around and in contact with the outer surface of permanent magnet 15. An inner permanent cladding magnet 19 array is shown disposed interiorly of the inner permanent magnet 13. The cladding magnets extend longitudinally substantially from one end of the device to the other, thicker portions thereof, in each instance, being arranged at the outermost ends of the concentric permanent magnets 13, 15, with diminishing circumferential dimension of the cladding magnets occurring between the outer ends and the midpoint of the device where the circumferential dimension is in each case minimal, that is to say minimal for the outer cladding magnets and maximal for the inner cladding magnets because of the nature of the thickness diminution towards the center point.

The ends of the annular flux chamber 31 defined by the inner and outer permanent magnets 13, 15, are closed by iron pole pieces 21, 21', annular in shape and washer-like, to effectively close over the ends of the flux space and be in contact with the ends of the inner and outer permanent magnet 13, 15 elements.

An arrangment of annular bucking magnets, 23, 25, 27 and 23', 25', 27' is arrayed at each end of the device. The flux in the annular permanent magnet bucking elements is disposed to join in the linear propagation of the flux in the annular space, that is to say the flux at the right end of the device is shown extending axially with the developed flux indicated by the main arrow in the annular space, and the flux in the left end bucking magnets is shown, similarly, substantially aligned with the main flux developed.

The axially extending magnets 13, 15 are selected of appropriate thickness to provide the desired flux for the annular space design. The iron pole or flange pieces 21, 21' act as pole pieces to distribute the flux uniformly about the cylindrical magnetic structure. The radially oriented flux in the cladding magnets 17 and 19 clads the outer and inner surfaces of the axial magnets to prevent flux leakage to the exterior and/or the interior of the device. If the field in the working space is to be uniform, the maximum thickness, t, of the cladding magnets is given by the expression $$t=H_wX/2B_\gamma$$

where X is the axial distance in centimeters of the point at which it is measured to the arbitrary plane of zero magnetic potential, (at the midpoint plane in the illustrated embodiment), $H_w$ is the working space field strength in kiloOersteds, and $B_\gamma$ is the remanence in kiloGauss of the radial magnet which, like all other magnets in the system, is assumed to have a square hysteresis loop.

To prevent flux leakage from the outside faces of the device, the bucking magnets, 23, 25, 27 are selected to be of a thickness $$t_b=H_wL/2B_\gamma$$

which are disposed and placed as shown in the drawing.

The result is a uniform axial magnetic field developed in the annular space 31 between the coaxially disposed and interiorly and exteriorly cladded permanent magnets 13, 15. The amount of material needed in the axial magnets of such a structure is considerably less than that which would be required to produce an equal field over the entire cylindrical cross section of the interior. Significantly more material, however, is required in the cladding magnets structures, because to enclose the annular section, the inner cladding magnets 19 are required, whereas, in a structure to confine only cylindrically arrayed magnetic flux, a simple cladding magnet structure like 17 would be required only exteriorly of the cylindrical working space. On the other hand, the annular configuration requires significantly less material for the pole pieces at the end of the annular space as well as for the bucking magnets to prevent unwanted dispersion or leakage of the flux.

The flux in the annular space 31 is given by the equation $$\Phi_w=\pi H_w(\gamma_o^2-\gamma_i^2)$$

where $\Phi_w$ is the flux in kiloMaxwells, $H_w$ is the field strength in kiloOersteds, and $\gamma_o$, $\gamma_i$ are, respectively, the outer and inner radii of annular space 31 in which $\Phi_w$ obtains. The flux is supplied by two annular axially aligned magnets of equal cross-sectional areas, defining the annular space 31 as shown.

It is important to note that the cross-sectional areas of the inner and outer supply magnets should be of the same area in order to produce an even flux in the working space, annular space 31 between the two shells forming the main magnetic driving structure.

By the well-known algebraic, geometric, and trigonometric methods, the exact design dimensions of particular elements of particular materials can be calculated to produce the desired results of magnets according to my invention. It has been found that certain limits on design are dictated by practicality. Specifically, it has been found that small L/r ratios favor annular confinement of flux because they lead to smaller magnetomotive force between the ends of the working space, hence to a smaller relative cladding magnet thickness. Lower or smaller remenance values also favor annular configuration of flux confinement for the same reason as given hereinabove, that is, a smaller magnetomotive force can be easily contained in the working space. It has also been found that small $\gamma_o/\gamma_i$ ratios favor the annular confinement feature of my invention because the large reduction in working space cross-section that results necessarily involves the production of less magnetic flux. This leads to the utilization of smaller base elements, annular rings and smaller bucking magnets in pole pieces.

It is also important to note that the materials for use in the driving or annular sleeve or tube magnets should be those having the magnetic characteristic of square hysteresis which is found uniquely in the rare earth magnet materials and in alloys thereof. Examples of these are the 1–5 and 2–17 summariam cobalt magnets which have the square hysteresis loop feature and can be advantageously temperature compensated for use in my invention. The hard ferrites also provide useful materials, as do the alloys of cobalt-niobium.

The conception and development of internal cladding designs and structures for use with annular magnetic flux confinement is thus, a viable one provided that the structures are sufficiently proportioned to be feasible from an application and an engineering sense. Some of the typical applications for such magnetic devices are in storage rings use in conjunction with high harmonic gyrotrons, and for magnetron applications in coaxial wave guide devices.

In the light of the foregoing disclosure, read in conjunction with the drawing, it is likely that numerous alternative embodiments will occur to persons familiar with the art. It is therefore intended that the foregoing disclosure and description be considered as illustrative only, and not in any limiting sense, it being intended to define the invention in terms of the appended claims.

What is claimed is:

1. A magnetic device for the production and substantially flux leakage free control and maintenance of a longitudinally extending annular cross-section magnetic field, comprising, in combination:

an inner and outer cylindrical permanent magnet pair concentrically disposed and extending longitudinally to define an annular space therebetween;

a first array of cladding magnets disposed exteriorly of said permanent magnet pair, extending longitudinally concentrically therewith and tapering in diminishing thickness from their ends towards and to a plane of zero magnetic potential transversely through the device; and a second array of cladding magnets arranged interiorly of said permanent magnet pair, extending longitudinally concentrically therethrough and tapering in diminishing thickness from their ends towards and to a plane of zero magnetic potential transversely through the device.

2. Apparatus according to claim 1 wherein the respective flux orientations of said permanent magnet pair and the said arrays of cladding magnets are transverse.

3. Apparatus according to claim 1 wherein the permanent magnet pair and the first and second cladding magnets are characterized by having square hysterises characteristics.

4. Apparatus according to claim 1 wherein flux in the permanent magnet pair is oriented in axial longitudinally parallel alignment with said magnetic field, and flux in said first and said second arrays of cladding magnets is oriented radially transverse to the permanent magnet pair flux.

5. Apparatus according to claim 1 in combination with iron pole pieces and bucking magnets operably disposed at each of the longitudinal ends of said device.

* * * * *